US005743713A

United States Patent [19]

Hattori et al.

[11] Patent Number: 5,743,713

[45] Date of Patent: Apr. 28, 1998

[54] BLADE, TURBINE DISC AND HYBRID TYPE GAS TURBINE BLADE

[75] Inventors: Mitsuru Hattori, Ama-gun; Keiichiro Watanabe, Kasugai, both of Japan

[73] Assignee: NGK Insulators, Ltd., Nagoya, Japan

[21] Appl. No.: 713,445

[22] Filed: Sep. 13, 1996

[30] Foreign Application Priority Data

Sep. 21, 1995 [JP] Japan ..... 7-242666

[51] Int. Cl.[6] ..... B63H 1/20

[52] U.S. Cl. ..... 416/215; 416/223 A; 416/241 B; 416/248

[58] Field of Search ..... 416/215, 216, 416/217, 218, 241 B, 241 R, 223 A

[56] References Cited

U.S. PATENT DOCUMENTS 2,435,427 2/1948 Eastman ..... 416/215

3,597,109 8/1971 Petrie ..... 416/217

4,483,659 11/1984 Armstrong ..... 416/223 A 5,580,219 12/1996 Frey et al. ..... 416/217

OTHER PUBLICATIONS

H. Yanagida, "Fine Ceramics," published by Ohm Inc., Sep. 20, 1982 (p. 177, line 6 to line 16 and Figs. 6.3 and 6.4).

*Primary Examiner*—Thomas E. Denion

*Attorney, Agent, or Firm*—Kubovcik & Kubovcik

[57] ABSTRACT

A ceramic blade for a hybrid type gas turbine blade has a dovetail portion, a platform portion formed on the dovetail portion and blade portions formed on the platform portion. The number of the blade portions formed on one platform portion is two or more. The upper surface of the platform portion is shaped into an arc-like form, and the dovetail portion is linearly formed in a tangential direction to a turbine rotation direction. By the utilization of this blade, the hybrid type gas turbine blade can inhibit the leakage of a gas and can be easily manufactured and is excellent in durability.

4 Claims, 6 Drawing Sheets

BLADE, TURBINE DISC AND HYBRID TYPE GAS TURBINE BLADE

BACKGROUND OF THE INVENTION (i) Field of the Invention

The present invention relates to a blade and a turbine disc for use in a hybrid type gas turbine blade as well as the hybrid type gas turbine blade comprising these members.

(ii) Description of the Related Art

As a result of the improvement of thermal efficiency, there is a tendency that a temperature at the turbine inlet of a gas turbine rises year by year. With the rise of the turbine inlet temperature, there has been developed a turbine blade called a hybrid type gas turbine blade in which the blade portions of the gas turbine blade directly exposed to a combustion gas are made of ceramics having an excellent heat resistance in place of a conventional heat-resistant alloy.

FIG. 5 shows one embodiment of a blade for use in a conventional hybrid type gas turbine blade. In this drawing, a platform portion 1*c* is formed on a dovetail portion 1*a* for fixing itself to a turbine disc, and on this platform portion 1*c*, a blade portion 1*b* is integrally formed. This blade 1 is, as shown in FIG. 6, attached to a metallic turbine disc 3 by mounting the dovetail portions 1*a* in grooves 3*c* formed on the outer periphery of the turbine disc 3. In this connection, buffers 5 made of an Ni alloy, a Co alloy or the like are usually interposed between the grooves 3*c* and the dovetail portions 1*a*, respectively, so as to buffer stress generated between the ceramic blade and the metallic turbine disc.

In the case of the conventional blade shown in FIG. 5, only one blade portion 1*b* is formed on one platform portion 1*c*, and therefore, when many blade portions are attached to the turbine disc 3 as shown in FIG. 6, many spaces are present between the adjacent blade portions 1. Hence, there is a problem that a large amount of a gas leaks through these spaces.

Furthermore, in the conventional turbine disc 3, it is difficult to insert the buffers 5 into the grooves 3*c* at the time of the attachment of the blade 1, so that a defect such as end tooth bearing at contact positions occurs, and durability is poor and there is a problem that the large unevenness of the durability takes place among the manufactured blades. In addition, the blades 1 must be mounted in the grooves 3*c* one by one, and so workability is also poor.

SUMMARY OF THE INVENTION

The object of present invention is to solve the conventional various problems mentioned above.

According to the present invention, there is provided a ceramic blade for use in a hybrid type gas turbine blade, the ceramic blade comprising a dovetail portion, a platform portion formed on the dovetail portion and blade portions formed on the platform portion, the number of the blade portions formed on one platform portion being two or more, the upper surface of the platform portion being shaped into an arc-like form, the dovetail portion being linearly formed in a tangential direction to a turbine rotation direction.

Furthermore, according to the present invention, there is provided a metallic turbine disc for use in a hybrid type gas turbine blade, having grooves on its outer periphery for fixing dovetail portions, the turbine disc comprising a combination of two divided portions into which the turbine disc is divided so that the divided surfaces of the turbine disc may be formed at substantially right angles to the axial direction of the turbine disc, a shim being inserted between the two divided portions.

Additionally, according to the present invention, there are provided a hybrid type gas turbine blade comprising; a ceramic blade comprising a dovetail portion, a platform portion formed on the dovetail portion and blade portions formed on the platform portion, the number of the blade portions formed on one platform portion being two or more, the upper surface of the platform portion being shaped into an arc-like form, the dovetail portion being linearly formed in a tangential direction to a turbine rotation direction, and a metallic turbine disc having grooves on its outer periphery for fixing the dovetail portion, the turbine disc comprising a combination of two divided portions into which the turbine disc is divided so that the divided surfaces of the turbine disc may be formed at substantially right angles to the axial direction of the turbine disc, a shim being inserted between the two divided portions, the ceramic blade being attached to the metallic turbine disc.

DETAILED DESCRIPTION OF THE PREFERRED EMBODIMENT

A blade for a hybrid type gas turbine blade of the present invention has two or more blade portions formed on one platform portion. A plurality of blade portions can be formed on the one platform portion and then attached to a turbine disc to constitute a turbine blade, whereby the number of spaces between the adjacent blades can be reduced and an amount of a gas which leaks through these spaces can be reduced.

Figure 1:
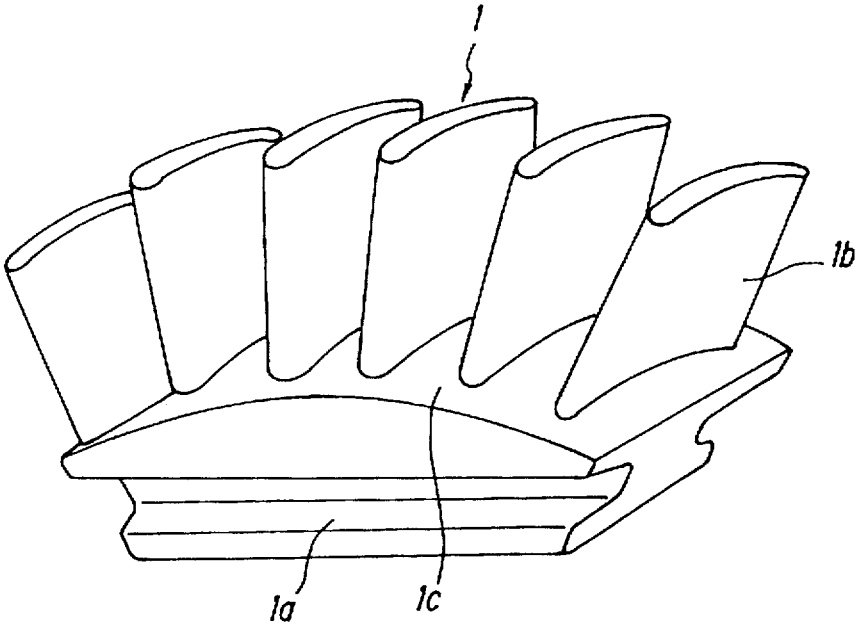
FIG. 1 is a perspective view illustrating one embodiment of a blade for a hybrid type gas turbine blade regarding the present invention.
Figure 2:
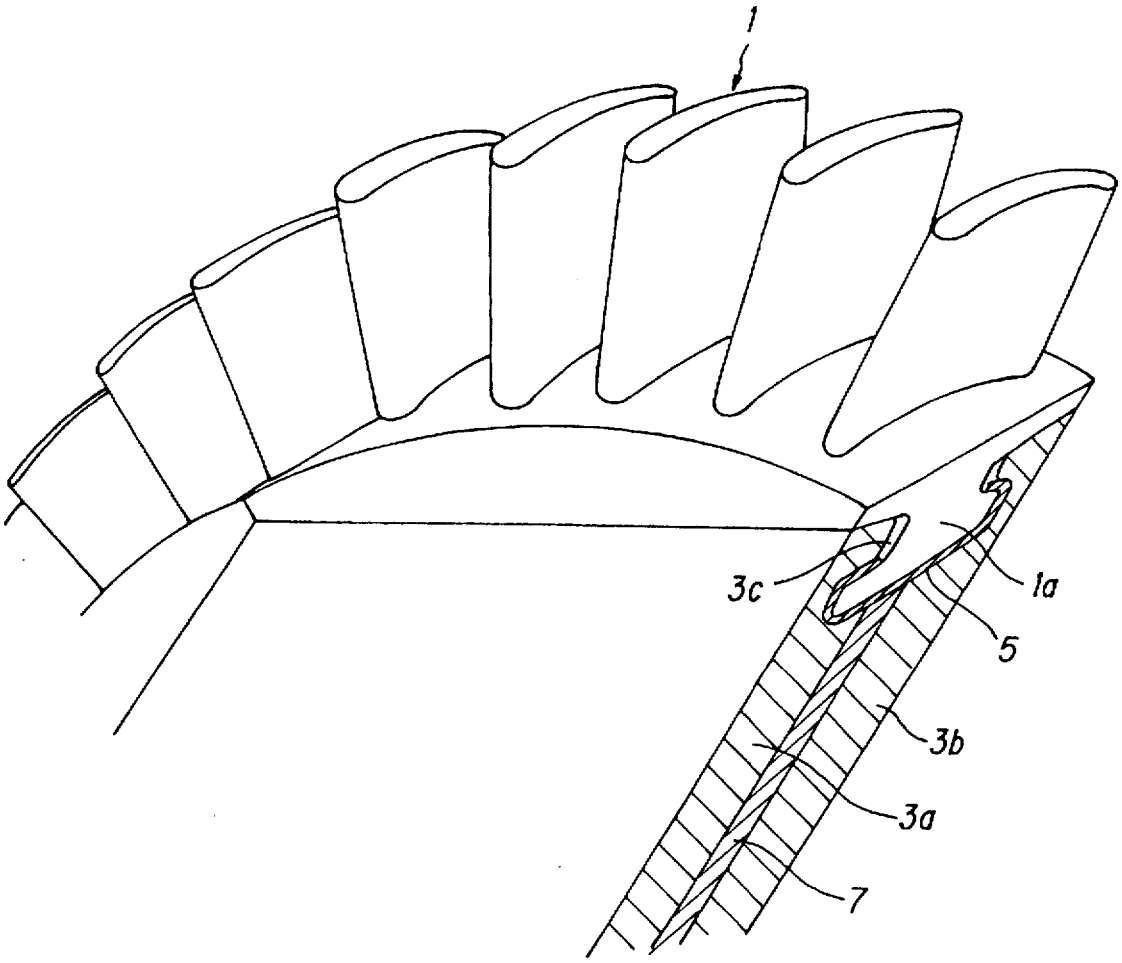
FIG. 2 is a perspective view illustrating the attachment of the blade regarding the present invention to a turbine disc.
Figure 5:
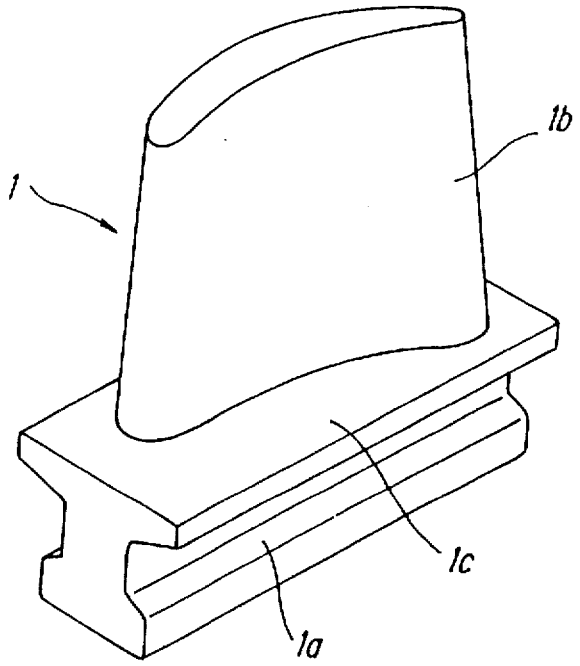
FIG. 5 PRIOR ART
FIG. 5 is a perspective view illustrating one embodiment of a blade for a conventional hybrid type gas turbine blade.

For example, FIG. 1 shows an embodiment of the blade in which six blade portions 1*b* are formed on one platform portion 1*c*, but when this blade 1 is attached to turbine disc portions 3*a*, 3*b* to constitute a turbine blade as shown in FIG. 2, the number of spaces between the contact surfaces of the adjacent blades can be reduced to ⅙ as compared with an embodiment in which the turbine blade is constituted by the use of the blade comprising one platform portion 1*c* and one blade portion 1*b* formed thereon as shown in FIG. 5. Incidentally, in order to reduce the number of the spaces, the larger the number of the blade portions formed on one platform is, the better, but if the number of the blade portions is excessively large, the volume of a blade root portion is too large, so that the strength reliability of the blade deteriorates. Therefore, it is preferred that the number of the blade portions on one platform is ⅙ or less of the total number of the blade portions formed on one metallic turbine disc.

As shown in FIG. 1, the upper surface of the platform portion 1*c* in the blade of the present invention is shaped into an arc-like form so that a circular surface may be made by the platform portion when all the blades are attached to the disc. On the other hand, a dovetail portion 1*a* which is fixed in the grooves of the turbine disc is linearly shaped in a tangential direction to a turbine rotation direction, because if the dovetail portion 1*a* is shaped into the arc-like form as in the case of the upper surface of the platform portion 1*c*, the working of the dovetail portion and the corresponding grooves of the turbine disc is difficult.

As a material for the blade of the present invention, there can be suitably used silicon nitride, silicon carbide, sialon or the like which has been heretofore used as a material for the blade of the hybrid type gas turbine blade.

Next, reference will be made to the turbine disc for the hybrid type gas turbine blade according to the present invention.

As shown in FIG. 2, the turbine disc of the present invention comprises the combination of two divided portions 3*a*, 3*b* into which the turbine disc is divided so that the divided surfaces of the turbine disc may be formed at substantially right angles to the axial direction of the turbine disc. In this turbine disc, the dovetail portion 1*a* of each blade 1 around which a buffer 5 is wound is mounted in a groove 3*c* of the one divided portion 3*a* (or 3*b*), and it is further fixedly mounted in the other divided portion 3*b* (or 3*a*) with the interposition of a shim 7, whereby the attachment of the blade to the turbine disc can easily be carried out and the generation of a defect can also be inhibited. The grooves 3*c* are formed on the outer peripheries of the divided portions 3*a*, 3*b* having a shape corresponding to that of the dovetail portions 1*a* so that these dovetail portions 1*a* of the blade 1 may be securely fixed in these grooves via the buffers 5.

Figure 3:
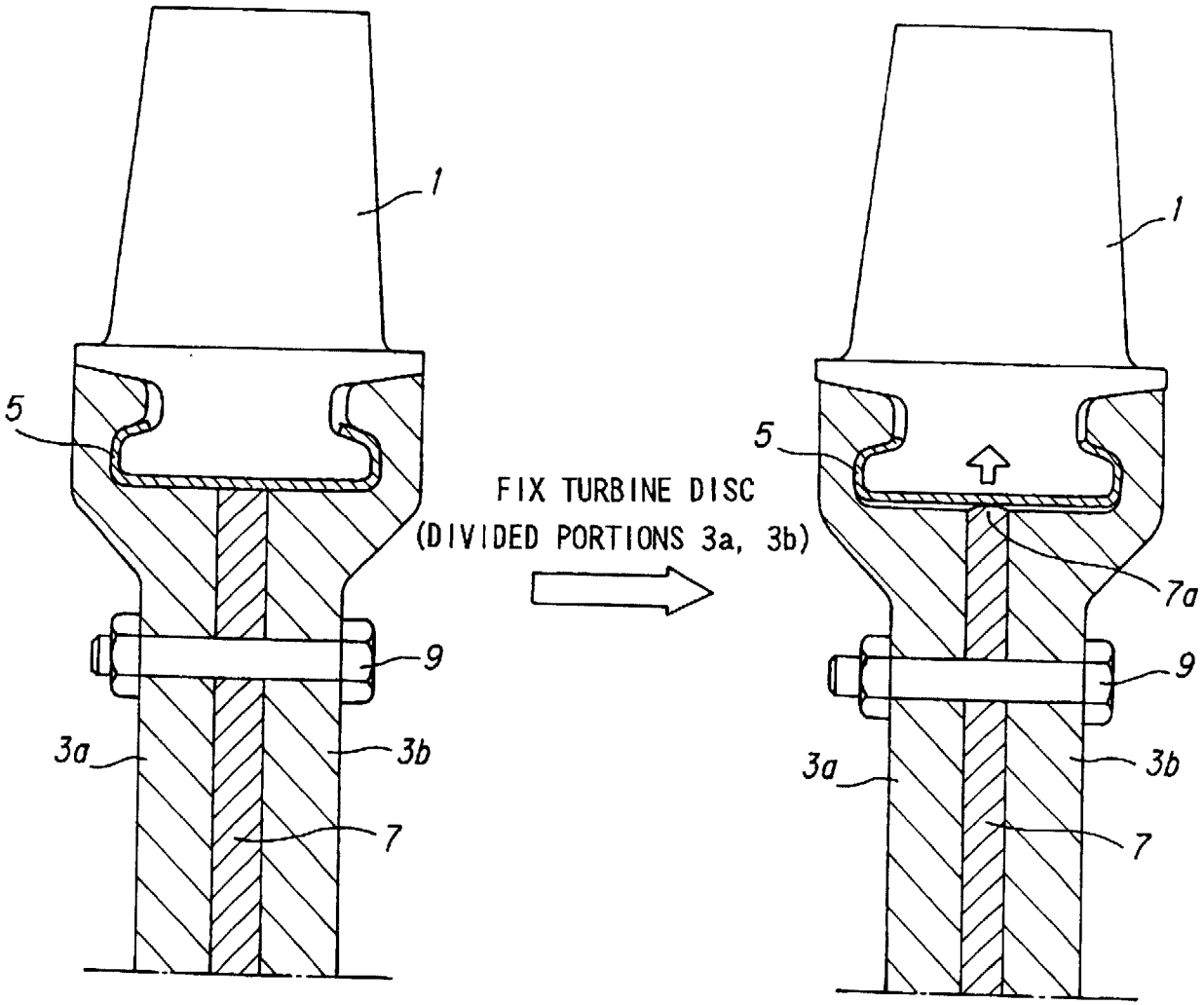
FIG. 3 is a partially sectional view illustrating one embodiment of the turbine disc regarding the present invention.

Furthermore, as shown in FIG. 3, in the turbine disc of the present invention, the shim 7 made of a Ti alloy or the like is inserted between the divided portions 3*a*, 3*b*. The divided portions 3*a*, 3*b* can be fixed by the use of, for example, a bolt 9 in a state where the shim 7 is interposed, and they can be strongly fastened by this bolt 9. At this time, the thickness of the shim 7 is reduced by the fastening pressure, and its end portion 7*a* is simultaneously swelled, so that the buffer 5 and the blade 1 are pushed up together, with the result that the height of the blade 1 slightly increases.

Figure 4:
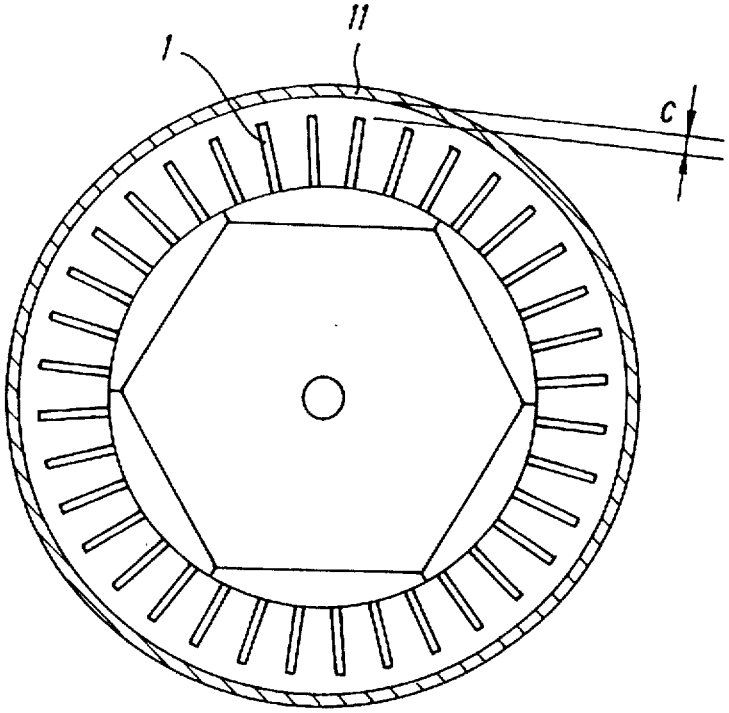
FIG. 4 is a schematic view illustrating the tip clearance of the hybrid type gas turbine blade set in an outer cylinder.

Therefore, the height of the blade 1 can be finely adjusted by regulating the fastening state of the divided portions 3*a*, 3*b*. In consequence, when the gas turbine blade is set in an outer cylinder 11 as shown in FIG. 4, a distance between the inner surface of the outer cylinder 11 and the tip of the blade 1 (a turbine blade tip clearance) can be finely controlled with ease, which leads to the improvement of performance.

As a material for the turbine disc of the present invention, there can be used an Ni-based, a Co-based or another metal-based heat-resistant alloy which has been heretofore used. To the turbine disc of the present invention, the blade can be attached in which only one blade portion is formed on one platform portion, but it is preferable to attach the blade of the present invention in which a plurality of the blade portions are formed on one platform portion, because the hybrid type gas turbine blade having a gas leakage reducing effect and the like can be manufactured.

Next, the present invention will be described in more detail with reference to an embodiment, but the scope of the present invention should not be limited to this embodiment.

Embodiment

Six blades made of silicon nitride in which 6 blade portions 1*b* were formed on one platform portion 1*c* as shown in FIG. 1 were fixedly attached to the divided portions of a turbine disc made of Incoloy 901 to manufacture a hybrid type gas turbine blade having 36 blade portions in all. At this time, buffers made of an Ni alloy were interposed between the dovetail portions of the blade and the grooves of the disc, and a shim made of a Ti alloy was inserted between a pair of divided disc portions. In this way, 6 samples of the hybrid type gas turbine blade were manufactured, and a destructive rotation test was carried out at room temperature. The results are shown in Table 1.

Comparative Embodiment

Figure 6:
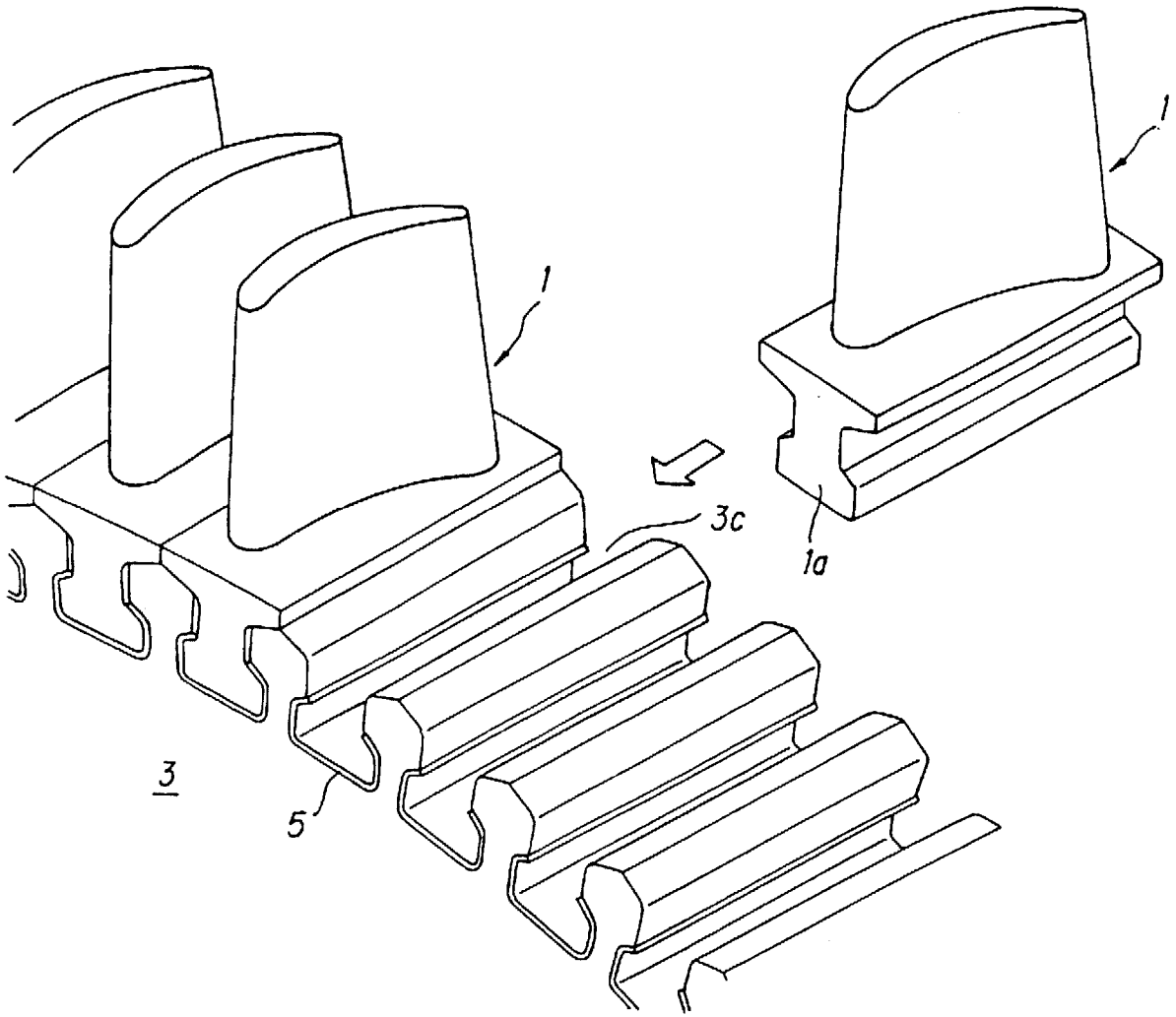
FIG. 6 PRIOR ART
FIG. 6 is a perspective view illustrating the attachment of the blade to the turbine disc in the conventional hybrid type gas turbine blade.

As shown in FIG. 6, 36 blades made of silicon nitride in which only one blade portion 1*b* was formed on one platform portion 1*c* as shown in FIG. 5 were fixedly attached to a turbine disc 3 made of Incoloy 901 to manufacture a hybrid type gas turbine blade having 36 blade portions in all. In this connection, buffers 5 made of an Ni alloy were interposed between the dovetail portions of the blades 1 and the grooves 3*c* of the disc 3. In this way, 36 samples of the hybrid type gas turbine blade were manufactured, and a destructive rotation test was carried out at room temperature. The results are shown in Table 1.

TABLE 1

Results of Destructive Rotation Test at Room Temperature (rpm)

| | | |
|---|---|---|
| Embodiment | Measured values of samples (Evaluated samples = 6) 54,400, 59,400, 56,800, 52,500 61,000, 60,500 | Average destructive rotation number = 57,400 Standard deviation = 3,500 Maximum destructive rotation number = 61,000 Minimum destructive rotation number = 52,500 (Maximum − Minimum) destructive rotation number = 8,500 |
| Comparative Embodiment | Measured values of samples (Evaluated samples = 36) 48,100, 39,800, 46,900, 51,200 59,800, 32,500, 58,200, 48,600 53,700, 50,700, 39,800, 42,900 36,700, 59,100, 33,500, 40,600 49,100, 41,800, 57,100, 57,000 41,400, 46,600, 39,100, 50,100 47,600, 51,200, 38,700, 49,000 38,500, 47,100, 51,100, 41,800 37,400, 60,200, 48,500, 46,000 | Average destructive rotation number = 46,700 Standard deviation = 7,500 Maximum destructive rotation number = 60,200 Minimum destructive rotation number = 32,500 (Maximum − Minimum) destructive rotation number = 27,700 |

As shown in Table 1, the products of the embodiment regarding the present invention are more excellent in durability on the average and have a less unevenness among these respective products than the products of the comparative embodiment regarding the conventional technique.

According to the present invention, a hybrid type gas turbine blade can be provided which can inhibit the leakage of a gas and which can be easily manufactured and which is excellent in durability. A gas turbine using this hybrid type gas turbine blade is excellent in heat resistance and durability, and the tip clearance of the turbine blade can be finely controlled, which leads to the improvement of performance.

What is claimed is:

1. A ceramic blade for use in a hybrid type gas turbine blade, the ceramic blade comprising a longitudinally extending dovetail portion, a platform portion formed on the dovetail portion and blade portions formed on the platform portion, wherein the blade portions are arranged substantially perpendicular to a longitudinal axis of the dovetail portion, the number of blade portions formed on one platform being two or more, the upper surface of the platform portion being shaped into an arc-like form, wherein said arc-like form extends in the longitudinal direction of the dovetail portion, the dovetail portion being linearly formed in a tangential direction to a turbine rotation direction.

2. A ceramic blade according to claim 1, wherein the number of the blade portions formed on one platform portion is ⅙ or less of the total number of the blade portions formed on one metallic turbine disc.

3. A metallic turbine disc for use in a hybrid type gas turbine blade, having grooves on its outer periphery, said grooves having an upper portion and a lower portion for fixing dovetail portions, and said grooves being noncontinuously oriented in said outer periphery, the turbine disc comprising a combination of two divided portions into which the turbine disc is divided so that the divided surfaces of the turbine disc are formed at substantially right angles to the axial direction of the turbine disc, and a shim being inserted between the two divided portions, an upper end of said shim terminating at said lower portion of the grooves.

4. A hybrid type gas turbine blade comprising:

a ceramic blade comprising a longitudinally extending dovetail portion, a platform formed on the dovetail portion and blade portions formed on the platform portion, wherein the blade portions are arranged substantially perpendicular to a longitudinal axis of the dovetail portion, the number of the blade portions formed on one platform portion being two or more, the upper surface of the platform portion being shaped into an arc-like form, wherein said arc-like form extends in the longitudinal direction of the dovetail portion, the dovetail portion being linearly formed in a tangential direction to a turbine rotation direction, and a metallic turbine disc having grooves on its outer periphery, said grooves having an upper portion and a lower portion for fixing the dovetail portion, said grooves being noncontinuously oriented in said outer periphery, the turbine disc comprising a combination of two divided portions into which the turbine disc is divided so that the divided surfaces of the turbine disc may be formed at substantially right angles to the axial direction of the turbine disc, and a shim being inserted between the two divided portions, an upper end of said shim terminating at said lower portion of the grooves, and the ceramic blade being attached to the metallic turbine disc.

* * * * *